US008620186B2

(12) United States Patent
Yoshida et al.

(10) Patent No.: US 8,620,186 B2
(45) Date of Patent: Dec. 31, 2013

(54) IMAGE FORMING APPARATUS

(75) Inventors: Michihiro Yoshida, Tokyo (JP); Jiro Kinokuni, Abiko (JP); Shota Soda, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 89 days.

(21) Appl. No.: 13/158,670

(22) Filed: Jun. 13, 2011

(65) Prior Publication Data

US 2011/0318060 A1 Dec. 29, 2011

(30) Foreign Application Priority Data

Jun. 25, 2010 (JP) ..... 2010-145309

(51) Int. Cl.
*G03G 15/02* (2006.01)

(52) U.S. Cl.
USPC ..... 399/176; 399/175

(58) Field of Classification Search
USPC ..... 399/175, 176
See application file for complete search history.

(56) References Cited

U.S. PATENT DOCUMENTS 4,372,004 A * 2/1983 Vermillion ..... 15/182
4,741,942 A * 5/1988 Swift ..... 428/82
4,912,516 A * 3/1990 Kaieda ..... 399/312
5,508,879 A * 4/1996 Kitamura et al. ..... 361/221
5,708,929 A 1/1998 Adachi et al.
2008/0038017 A1 2/2008 Fujita et al.

FOREIGN PATENT DOCUMENTS

CN 101122766 A 2/2008
JP 59224868 A * 12/1984
JP 8-248785 A 9/1996
JP 2000-056538 A 2/2000
JP 2004-69849 A 3/2004
JP 2005-274894 A 10/2005

OTHER PUBLICATIONS

Notification of the First Office Action dated Sep. 17, 2013, in Chinese Application No. 201110171790.6.

* cited by examiner

*Primary Examiner* — Clayton E Laballe
*Assistant Examiner* — Leon W. Rhodes, Jr.
(74) *Attorney, Agent, or Firm* — Fitzpatrick, Cella, Harper & Scinto

(57) ABSTRACT

An image forming apparatus includes an image bearing member; a brush roller, rotatable in a predetermined rotational direction, contacted to the image bearing member; and an applying device for applying a bias to the brush roller. The brush roller includes a shaft and a woven fabric brush including fibers planted in a strip-like base material, which is wound helically about the shaft with a helical winding gap. The woven fabric brush is subjected to fiber slanting processing so that the fibers of the helically wound woven fabric brush are slanted, so as to cover the helical winding gap, from a downstream side toward an upstream side with respect to a longitudinal direction in which a helically extending widthwise edge of the base material appears to be moving when the brush roller rotates in the predetermined rotational direction.

8 Claims, 6 Drawing Sheets

(a)

(b)

(a)

(b)

(a)

(b)

(a)

(b)

IMAGE FORMING APPARATUS

FIELD OF THE INVENTION AND RELATED ART

The present invention relates to an image forming apparatus of an electrophotographic type, such as a copying machine, a printer or a facsimile machine.

In the image forming apparatus, the type in which a brush is used for electrically charging a photosensitive member has been known. Further, in order to adjust an electric charge of untransferred toner and to remove toner deposited on the photosensitive member or an intermediary transfer member, a constitution in which a bias is applied to the brush has been known.

In such a constitution in which a high voltage is used, a brush roller of an electrostatic planting type capable of uniformly planting fibers (fiber material) on a roller with respect to a longitudinal direction of the roller cannot be used. This is because a range of choice of a material capable of being chosen as the fibers of the brush of the electrostatic planting type is narrow and thus the brush roller cannot withstand endurance use in the case where a desired bias is applied to the brush roller and the brush roller is used.

Therefore, a constitution in which a wound brush roller having the range of choice, of the material capable of being chosen as the fibers, wider than that for the electrostatic planting has been known. The wound brush roller is manufactured by helically winding a woven fabric brush, obtained by planting the fibers in a strip-like substrate (base material), about a charging roller. This wound brush roller has high durability compared with the brush roller of the electrostatic planting type but causes a winding gap since the woven fabric brush is wound. This gap is created due to variation during manufacturing and therefore the brush with the winding gap of 0 mm cannot be manufactured at an efficiency percentage of 100%. Therefore, sparse/dense of a brush density occurs with respect to the longitudinal direction of the woven fabric brush.

When the photosensitive member is electrically charged by using such a brush, resistance non-uniformity occurs due to the sparse/dense of the brush (fibers) caused with respect to the longitudinal direction of the photosensitive member. Specifically, a helical winding gap portion (A1) as shown in FIG. 1 is created and the toner is accumulated by the endurance use, so that the accumulated toner results in the resistance non-uniformity. With respect to such a problem, Japanese Laid-Open Patent Application (JP-A) 2000-56538 has disclosed a constitution in which the base material of the woven fabric brush is superposed to control the sparse/dense of the brush with respect to the longitudinal direction.

However, as in the constitution described in JP-A 2000-56538, when portions of the base material are superposed on each other, a diameter of the portion where the base material is superposed (in the neighborhood of the winding portion) is larger than that of the portion where the base material is not superposed (at a central portion of the woven fabric brush with respect to a widthwise direction). For that reason, a contact state is changed between the superposed portion and non-superposed portion of the base material. For that reason, when the photosensitive member is charged by using the above-described brush as a charging brush, there was a problem such that the photosensitive member cannot be uniformly charged with respect to its longitudinal direction.

SUMMARY OF THE INVENTION

A principal object of the present invention is to provide an image forming apparatus in which a photosensitive member can be uniformly charged with respect to its longitudinal direction to reduce an occurrence of resistance non-uniformity.

According to an aspect of the present invention, there is provided an image forming apparatus comprising:

an image bearing member;

a brush roller, rotatable in a predetermined rotational direction, contacted to the image bearing member; and applying means for applying a bias to the brush roller, wherein the brush roller includes a shaft and a woven fabric brush including fibers planted in a strip-like base material which is wound helically about the shaft with a helical winding gap, and wherein the woven fabric brush is subjected to fiber-slanting processing so that the fibers of the helically wound woven fabric brush are slanted, so as to cover the helical winding gap, from a downstream side toward an upstream side with respect to a longitudinal direction in which a helically extending widthwise edge of the base material is seen moving when the brush roller rotates in the predetermined rotational direction.

These and other objects, features and advantages of the present invention will become more apparent upon a consideration of the following description of the preferred embodiments of the present invention taken in conjunction with the accompanying drawings.

Figure 2:
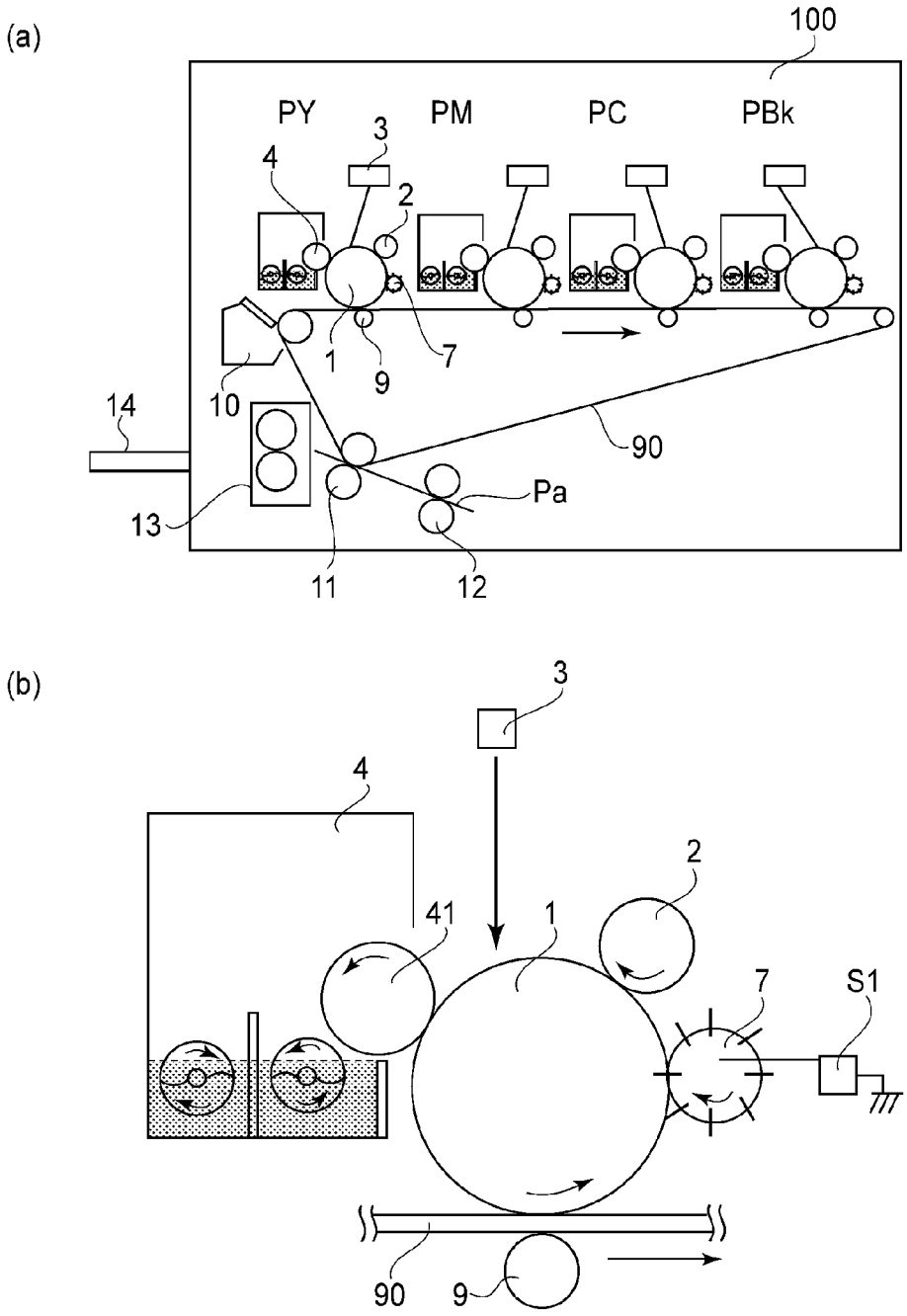

Parts (*a*) and (*b*) of FIG. 2 are schematic illustrations of an image forming apparatus according to an embodiment of the present invention.

Figure 3:
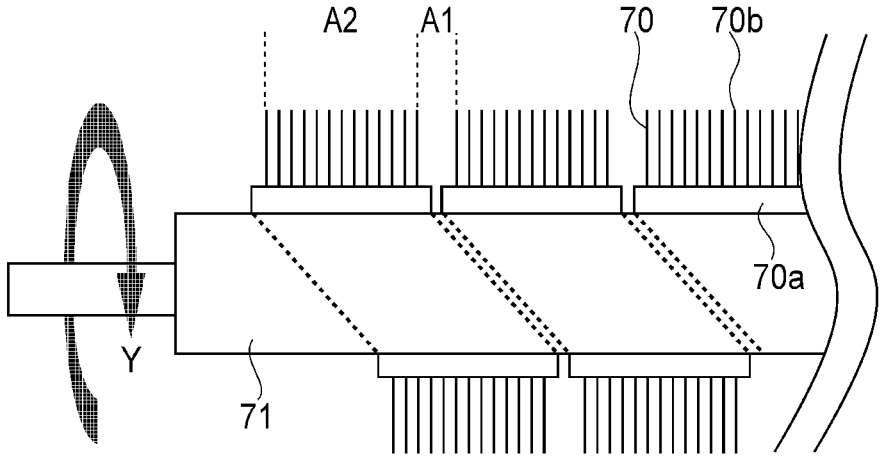
Figure 3:
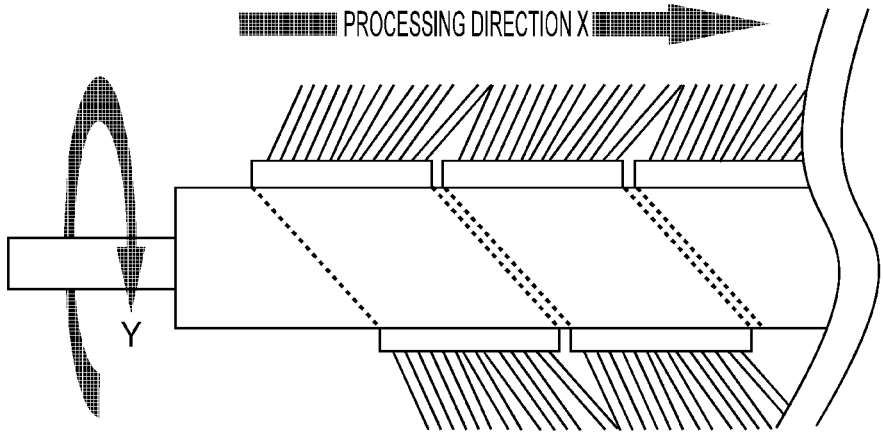

Parts (*a*) and (*b*) of FIG. 3 are schematic views for comparatively illustrating a conventional wound brush and a wound brush subjected to the fiber-slanting processing with respected to a longitudinal direction.

Figure 4:
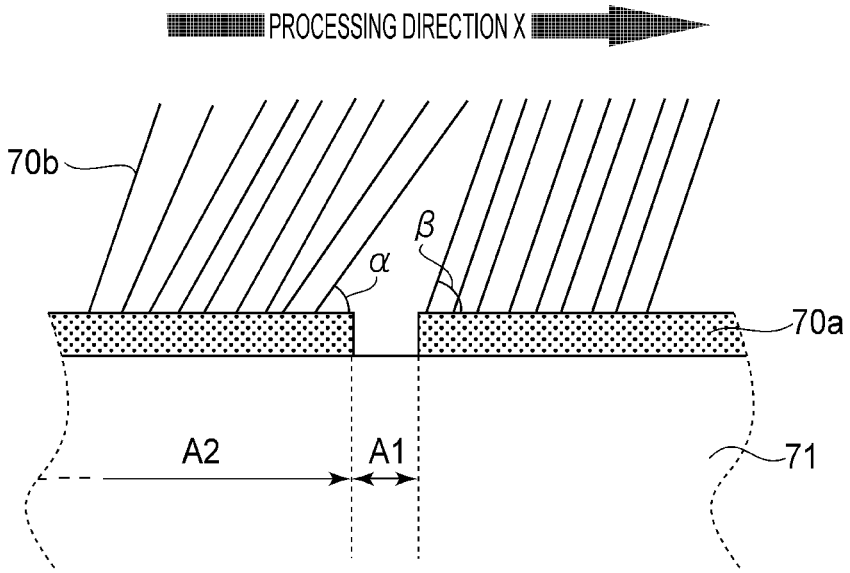

FIG. 4 is a schematic view for illustrating angles in the neighborhood of a helical winding gap of the wound brush subjected to the fiber-slanting processing with respect to the longitudinal direction.

Figure 5:
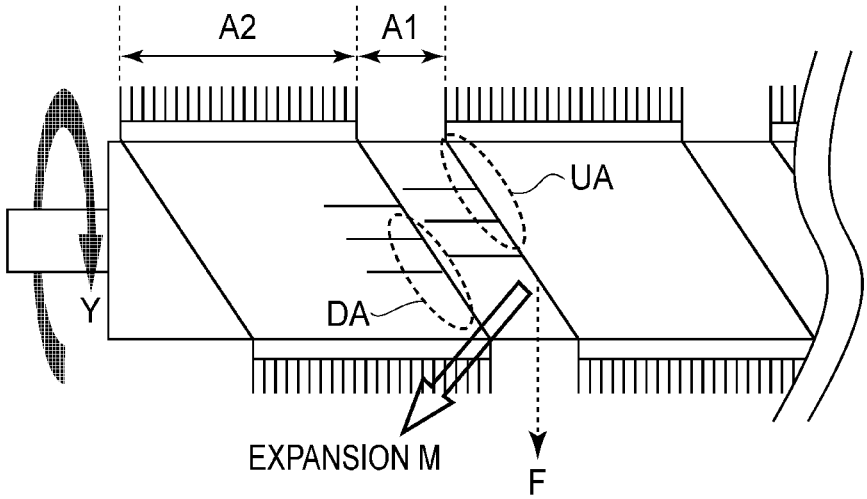
Figure 5:
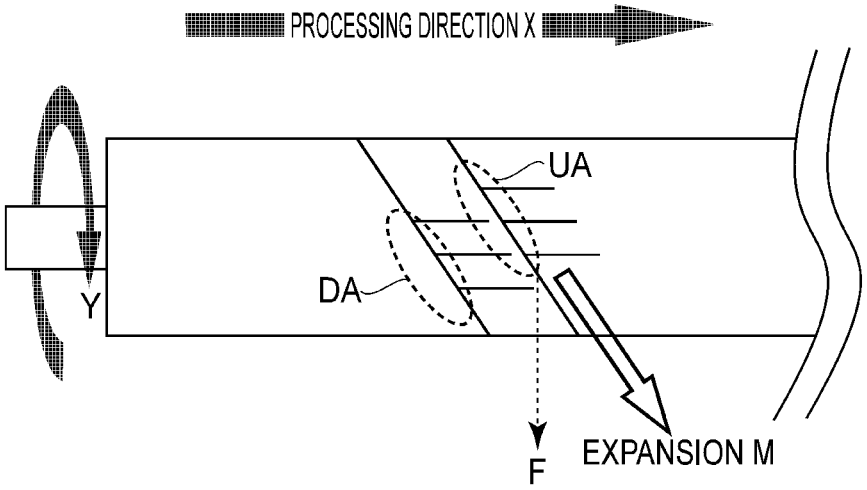

Parts (*a*) and (*b*) of FIG. 5 are schematic views for illustrating a relationship between a winding direction of the brush and a fiber-slanting processing direction.

Figure 6:
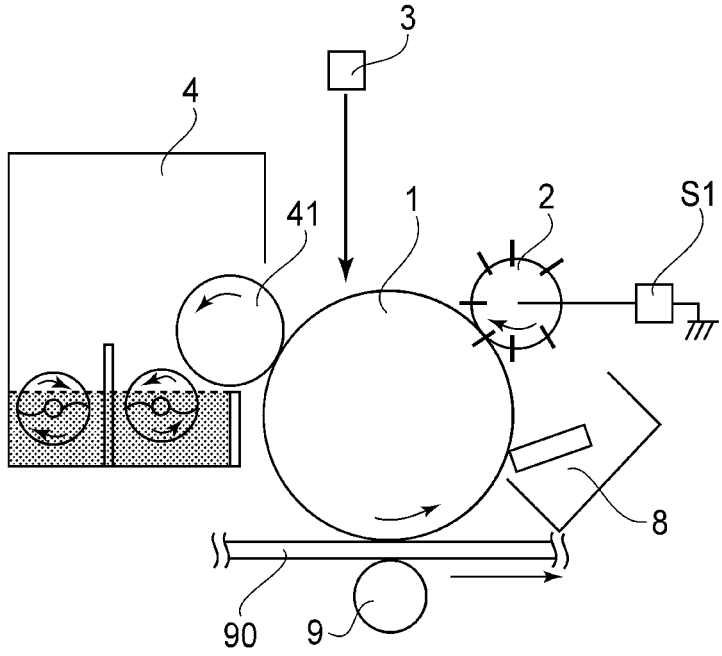
Figure 6:
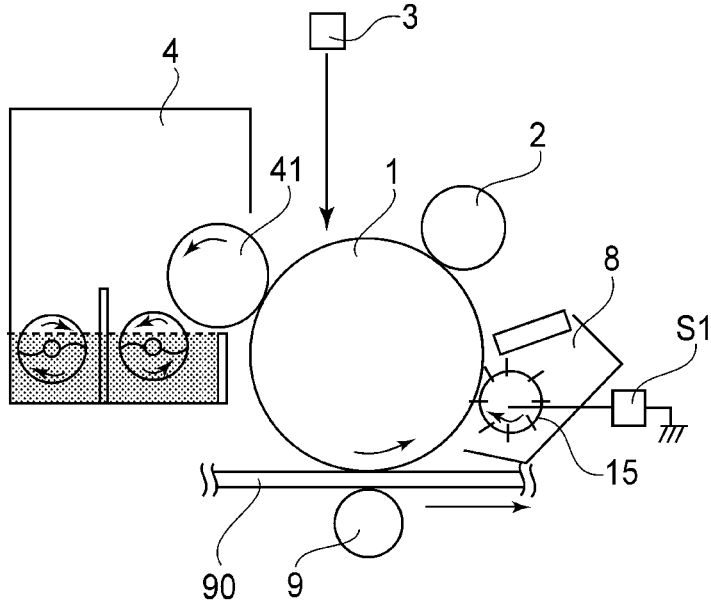

Parts (*a*) and (*b*) of FIG. 6 are schematic views for illustrating structures of image forming apparatuses in modified embodiments in which wound brushes which have been subjected to the fiber-slanting processing are used.

DESCRIPTION OF THE PREFERRED EMBODIMENTS

Embodiment 1

In this embodiment, a wound brush roller obtained by helically winding a strip-like brush about a charging roller is used as an auxiliary charging brush for adjusting an electric charge of untransferred toner. First, a schematic structure of an image forming apparatus will be described and then fiber-slanting processing of the brush roller will be described more specifically. Thereafter, durability evaluation using a brush roller which is subjected to the fiber-slanting processing and a brush roller which is not subjected to the fiber-slanting processing will be described.

1. Schematic Structure of Image Forming Apparatus (General Structure of Image Forming Apparatus)

Part (*a*) of FIG. 2 is a schematic view for illustrating a general structure of an image forming apparatus 100. The image forming apparatus 100 includes, as a plurality of image forming portions, process cartridges (PY, PM, PC, PBk) (hereinafter represented by P when the process cartridges are collectively explained). A toner image formed on a photosensitive member 1 at each of the image forming portions is transferred onto an intermediary transfer belt 90 (hereinafter referred to as ITB) by a primary transfer roller 9. A transfer material Pa conveyed from a sheet feeding cassette (not shown) is conveyed to a secondary transfer portion by a registration roller 21. Further, respective color toner images superposed on the intermediary transfer belt 90 as an image bearing member are conveyed to the secondary transfer portion, where the toner images are transferred onto a sheet-like transfer material (recording paper) Pa by a secondary transfer roller 11. Thereafter, the toner images transferred on the transfer material Pa are fixed on the transfer material Pa by a fixing device 13 and then the transfer material Pa is discharged onto a discharge tray 14. Further, toner remaining on the ITB without being transferred onto the transfer material Pa is removed by a cleaning blade 10 provided downstream of the secondary transfer portion with respect to a rotational direction of the ITB.

(Image Forming Portion)

In this embodiment, the process cartridges (PY, PM, PC, PBk) have a constitution in which they are detachably mountable to an apparatus main assembly. These process cartridges PY, PM, PC and PBk basically have the same constitution except for colors of the toners. Hereinafter, the process cartridge PY will be described more specifically.

Part (*b*) of FIG. 2 is a schematic view for illustrating a schematic structure of the process cartridge as the image forming portion used in this embodiment. Hereinbelow, steps for forming the toner image will be briefly described. First, the photosensitive member as the image bearing member is charged by a charging roller 2 as a photosensitive member charging means. The charged photosensitive member is exposed to laser light by a laser scanner 3 as an exposure means, so that an electrostatic image is formed. The electrostatic image formed on the photosensitive member is developed into the toner image with the toner carried on a developing sleeve of a developing device as a developing means. The thus formed toner image is transferred onto the intermediary transfer belt 90. Here, on the photosensitive member, the toner which is not completely transferred onto the intermediary transfer belt at the primary transfer portion (hereinafter referred to as untransferred toner) is deposited. The image forming apparatus in this embodiment employs a scheme for collecting the untransferred toner by adjusting the electric charge of the untransferred toner without removing the untransferred toner (hereinafter referred to as a cleaner-less scheme).

In the image forming apparatus using the cleaner-less scheme, in order to collect the untransferred toner in the developing device, an auxiliary charging brush for adjusting the electric charge of the untransferred toner is provided downstream of the primary transfer portion and upstream of the charging means with respect to the photosensitive member rotational direction. To the auxiliary charging brush, a DC bias (of a polarity identical to a normal charge polarity of the toner) for adjusting the electric charge of the untransferred toner is applied by a high-voltage power source S1 as an applying means. As a result, the untransferred toner remaining on the photosensitive member can be collected in the developing device. In this embodiment, the auxiliary charging brush 7 is contacted to the photosensitive member 1 and is rotated in a direction along the rotational direction of the photosensitive member 1. Here, the direction in which the rotatable auxiliary charging brush 7 is rotated during image formation is a rotational direction Y. Incidentally, a rotational speed of the auxiliary charging brush 7 (a movement speed of a brush axis) in this embodiment is set to be higher than that of the photosensitive member 1 (a movement speed of the photosensitive member surface) (1.4 times in this embodiment). As a result, it is possible to suppress fusion of the untransferred toner onto the photosensitive member 1. Further, the fibers of the auxiliary charging brush enter the photosensitive member 1 in a depth of 0.8 mm.

2. Auxiliary Charging Brush

Next, a structure of the auxiliary charging brush 7 will be described in detail.

(Structure of Wound Brush)

The wound brush used in this embodiment as the auxiliary charging brush will be specifically described.

Part (*a*) of FIG. 3 is a schematic view showing a conventional wound brush which is not subjected to fiber-slanting processing. Further, (*b*) of FIG. 3 is a schematic view showing the wound brush which is used as the auxiliary charging brush and is subjected to the fiber-slanting processing in this embodiment.

In order to adjust the electric charge of the untransferred toner, there is a need to apply a bias to the auxiliary charging brush. The brush of the electrostatic planting type capable of uniformly charging the fibers thereof has the narrow range of choice of the material used as the fiber material, so that it is difficult to obtain a desired performance. Therefore, in this embodiment, the wound brush which is manufactured by winding a woven fabric brush 70 about a charging roller is used. The woven fabric brush 70 consists of a strip-like base material (substrate) 70*a* and a fiber material 70*b* extended from the base material 70*a*. The strip-like wound brush 70 is helically wound about the charging roller 71 as an axis, so that a roller-shaped wound brush is manufactured. Incidentally, the brush base material 70*a* is bonded to the charging roller 71 by an electroconductive adhesive. Further, the charging roller 71 is supported by an electroconductive bearing (not shown) and thereto, a high voltage (auxiliary charging bias) is applied from the high-voltage power source S1. As a result, it is possible to adjust the electric charge of the untransferred toner deposited on the member without being transferred.

Further, the woven fabric brush will be described more specifically. The brush base material 70*a* consists of carbon (black)-containing synthetic fibers, and the fiber material 70*b* is nylon fibers. The woven fabric brush 70 is prepared by weaving (developing) the fiber material 70*b* into the brush base material 70*a*. Incidentally, the fiber material 70*b* is planted on the brush base material so that a fiber length is 2.5 mm and a density is 150 kF/inch2. Further, a fiber thickness of the fibers is 3 denier. Further, the woven fabric brush has a length of 11 mm with respect to the widthwise direction and is wound about the charging roller having a diameter of 9 mm so that the helical winding gap width (a width between adjacent base material portions) is 1.0 mm. Incidentally, as the material of the fibers, in addition to nylon, it is also possible to use rayon, acrylic polymer, polyester and the like. Further, the fiber length of the woven fabric brush may desirably be more than the helical winding gap. As described above, the wound brush in this embodiment is helically wound about the charging roller so that the brush base material portions are not superposed on each other. However, at an end portion of the base material, there is the case where the fibers are not planted so that the fibers of the woven fabric brush do not come out. In this case, the base material portions may also be superposed on each other to the extent such that an outer diameter of the wound brush in the neighborhood of the superposed portion of the base material portions is not increased to such a degree that non-uniformity occurs at a contact portion with the photosensitive member.

(Fiber-Slanting Processing)

Next, the fiber-slanting processing of the wound brush will be described. The wound brush in this embodiment is characterized by being subjected to the fiber-slanting processing along the longitudinal direction of the charging roller. Specifically, to the wound brush with uniform straight fibers as shown in (*a*) of FIG. 3, high-temperature vapor (about 200° C., $2.0\times10^5$ Pa) is applied, so that the fibers are subjected to the fiber-slanting processing as shown in (*b*) of FIG. 3. By this fiber-slanting processing, the fibers planted on the base material in a substantially vertical direction are aligned in a desired direction (indicated by an arrow X). The fiber-slanting processing is not limited to the processing by the high-temperature vapor. Further, the woven fabric brush may also be subjected to the fiber-slanting processing before the winding about the charging roller and then may be wound about the charging roller.

Here, the wound brush subjected to the fiber-slanting processing will be described. FIG. 4 is an enlarged view of the wound brush which has been subjected to the fiber-slanting processing. In FIG. 4, A1 represents the helical winding gap portion which is the gap between the base material portions of the woven fabric brush, and A2 represents a fiber portion planted on the base material. The fiber material at the widthwise end portion of the base material subjected to the fiber-slanting processing with respect to the fiber-slanting processing direction X is slanted to cover at least the helical winding gap portion A1.

Here, it may be said that the brush is subjected to the fiber-slanting processing in the case where 90% or more of the fiber material planted in a 0.1 mm-square area (0.1 mm×0.1 mm) on the brush is slanted in the desired direction (X direction). Incidentally, in the wound brush subjected to the fiber-slanting processing, about 97% of the fiber material was slanted toward the fiber-slanting processing direction X.

Next, a degree of the fiber slanting of the auxiliary charging brush (wound brush) 7 by the fiber-slanting processing will be described with respect to FIG. 4. FIG. 4 is an enlarged view of the gap (helical winding gap portion A1) of the woven fabric brush helically wound about the charging roller. An average of angles, of the fibers of the fiber material planted in a helical winding gap-upstream-side 0.1 mm-square area with respect to the fiber-slanting processing direction X, between the surface of the base material and the fibers is $\alpha$, and an average of angles, of the fibers of the fiber material planted in a helical winding gap-downstream-side 0.1 mm-square area with respect to the fiber-slanting processing direction X, between the surface of the base material and the fibers is $\beta$.

Here, in the case where each of the angles $\alpha$ and $\beta$ is 85 degrees or more, it turned out by study and evaluation that it was difficult to slant the fibers so as to cover the helical winding gap portion. On the other hand, in the case where each of the angles $\alpha$ and $\beta$ is 30 degrees or less, it turned out by study and evaluation that it was difficult to diffuse the toner deposited on the photosensitive member with the fiber material since the fiber material was contacted to the photosensitive member at its side surface. That is, it was found that the toner is liable to be accumulated in the helical winding gap and resistance non-uniformity due to endurance use becomes conspicuous. Further, as a result of the fiber-slanting processing by the high-temperature vapor as in this embodiment, it was found that the helical winding gap-upstream-side fiber material with respect to the fiber-slanting direction X is liable to be slanted in the fiber-slanting direction X more than the helical winding gap-downstream-side fiber material. When the above results are formulated, by satisfying: $30°<\alpha<\beta<85°$, even when the wound brush is contacted to the surface of the photosensitive member as the image bearing member on which the toner is deposited and a voltage is applied to the wound brush, it is possible to suppress the occurrence of the resistance non-uniformity with respect to the wound brush longitudinal direction. Incidentally, the wound brush in this embodiment was evaluated by using the wound brush having the fibers slanted, at an average slanting angle of about 76 degrees, toward the fiber-slanting processing direction X.

(Fiber-Slanting Processing Direction X and Brush Rotational Direction Y)

As described above, it was found that it is possible to suppress the occurrence of the resistance non-uniformity caused by the endurance use by subjecting the wound brush to the fiber-slanting processing along the wound brush longitudinal direction. As a result of further study, the present inventors had found that there is a preferable fiber-slanting processing direction. Specifically, it was found that the preferable fiber-slanting processing direction is present depending on a winding direction of the wound brush and a rotational direction of the wound brush. More specifically, the fiber-slanting processing direction includes a direction (X direction) shown in (*b*) of FIG. 3 and an opposite direction (−X direction) shown in (*b*) of FIG. 3. It was found by study that the number of sheets until the resistance non-uniformity recognized as image defect occurs is different depending on these fiber-slanting processing directions. The result of the study will be described later in 3 (Durability evaluation test of wound brush). Hereinafter, an assumed mechanism will be described with reference to FIG. 5.

Here, the brush roller rotational direction is defined as Y. A downstream-side fiber portion, with respect to a longitudinal direction in which a helically extending widthwise edge of the base material is seen moving when the brush roller rotates in the rotational direction Y, in the neighborhood of the helical winding gap portion A1 is defined as DA. An upstream-side fiber portion, with respect to the longitudinal direction in which the helically extending widthwise edge of the base material is seen moving when the brush roller rotates in the rotational direction Y, is defined as UA (opposite to DA with respect to the helical winding gap A1). In a conventional constitution shown in (*a*) of FIG. 5, the brush roller prepared by winding the woven fabric brush about the charging roller was not processed and therefore the fiber material is substantially vertical to the base material. Here, the wound brush is supplied with a charging bias and is contacted to the photosensitive member thus being rotated. Then, the fibers at the downstream-side fiber portion DA in the helical winding gap portion A1 are tilted toward a direction indicated by an arrow M in the figure. Specifically, by the rotation of the brush roller while contacting the photosensitive member, a force F is exerted on the fibers of the brush roller and the fibers on which the force F is exerted are expanded in an expansion direction M. For that reason, with respect to the wound brush which has not been subjected to the fiber-slanting processing, the toner is locally accumulated by the endurance use, so that the resistance non-uniformity occurs with respect to the brush longitudinal direction.

Here, when the fiber-slanting processing is performed toward the direction X shown in (*b*) of FIG. 5, the expansion direction X in which the fiber material receives and expands by the rotation follows a direction (winding angle) in which the woven fabric brush is helically wound. At this time, there is no direction M at the helical winding gap portion A1 side, in which the fibers at the downstream-side fiber portion DA expand. For that reason, the toner deposited on the surface portions of the fibers above the helical winding gap portion is not readily dropped toward a base portion of the helical winding gap. As a result, in the case where the brush roller subjected to the fiber-slanting processing direction X is used, it is possible to suppress the resistance non-uniformity caused with respect to the brush longitudinal direction by the endurance use.

3. Durability Evaluation Test of Wound Brush

Hereinbelow, a durability test result when the wound brush which is not subjected to the fiber-slanting processing (conventional constitution) and the wound brush subjected to the fiber-slanting processing (constitution in this embodiment) are used as the auxiliary charging brush is shown. As described above, there is a relationship between the wound brush rotational direction and the fiber-slanting direction. For that reason, the fiber-slanting processing was performed with respect to two directions X and −X. Incidentally, in either of the cases where the fiber-slanting processing was performed with respect to the two directions X and −X, even in endurance use, the wound brush subjected to the fiber-slanting processing provided a better result than the wound brush which was not subjected to the fiber-slanting processing.

Figure 1:
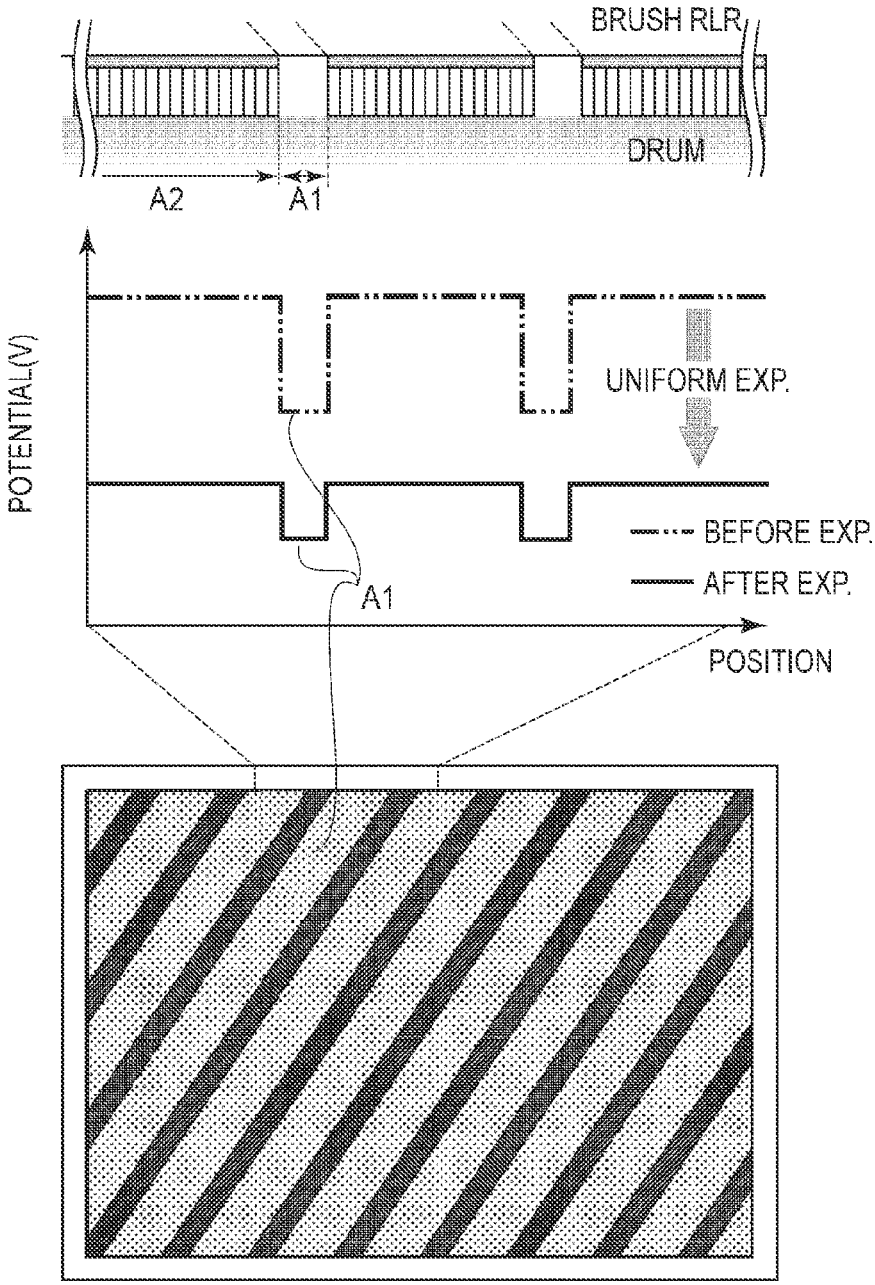
FIG.1 PRIOR ART
FIG. 1 is a schematic view for illustrating image defect which occurs in the case of a wound brush which has not been subjected to fiber-slanting processing.

The durability test was conducted by continuously outputting an image with image density (duty) of 20% (halftone develop) on a whole surface of an A4-sized sheet and then non-uniformity of the output image was evaluated. By the durability test, the image defect as shown in FIG. 1 occurs. At the same time, a potential difference ΔV was obtained by measuring an electric potential of two positions (areas) in which the potential difference contacts the fiber portion A2 and the helical winding gap portion A1. Incidentally, the image defect was evaluated by performing sensory evaluation by test subjects of 10 persons. Here, in the case where 10 persons judged the image defect as good, the evaluation result was "○". In the case where 7 persons or more judged the image defect as good, the evaluation result was "Δ". In the case where 6 persons or less judged the image defect as good, the evaluation result was "x".

TABLE 1

| | (sheets) | | |
|---|---|---|---|
| | 0 | 20,000 | 50,000 |
| Conv. | ○ (ΔV = 0 V) | x (ΔV = 100 V) | x (ΔV = 200 V) |
| EMB. 1 (−X) | ○ (ΔV = 0 V) | ○ (ΔV = 20 V) | Δ (ΔV = 50 V) |
| EMB. 1 (X) | ○ (ΔV = 0 V) | ○ (ΔV = 10 V) | ○ (ΔV = 30 V) |

As is understood also from Table 1, in the conventional constitution ("Conv."), the image defect with density non-uniformity occurred in the neighborhood of 20,000 sheets. At this time, the potential difference ΔV between the fiber portion A2 and the helical winding gap portion A1 was 100 V. For that reason, the potential of the photosensitive member was not able to be made uniform by the charging roller 2 located downstream of the wound brush with respect to the longitudinal direction in which the helically extending widthwise edge of the base material is seen moving when the brush roller rotates in the rotational direction Y, so that white dropout occurred at a portion corresponding to the helical winding gap portion A1. This is because of a resistance difference between the helical winding gap portion A1 and fiber portion A2 of the wound brush for adjusting the electric charge of the toner. When the number of sheets subjected to the durability test was increased, the degree of the image defect was worsened.

However, in the case where the wound brush which was subjected to the fiber-slanting processing was used, the occurrence of the density non-uniformity was not observed at a stage in which the halftone image was outputted on 20,000 sheets. Similarly, at the stage of the output of 20,000 sheets, the potential difference ΔV was 10 V. For that reason, it would be considered that the potential difference of about 10 V was made uniform by the charging roller and thus did not appear as a density difference. Further, in the case where the wound brush which was subjected to the fiber-slanting processing was used, even at a stage in which the halftone image was outputted on 50,000 sheets, the occurrence of the image defect such that the white dropout of the halftone image was generated in a pattern of the helical winding gap portion A1 was not observed. Similarly, the potential difference ΔV was 30 V and the potential difference of the photosensitive member after being charged by the downstream charging roller was merely a tolerable degree (±2 V). Incidentally, as a result of the durability test being conducted, it was found that when the potential difference ΔV between the portions A1 and A2 at a position downstream of the wound brush and upstream of the charging roller is within 40 V, the potential difference was made uniform by the charging roller and thus did not appear as the image defect.

From the above, with the fibers at the helical winding gap-rotation direction-downstream portion being slanted (fiber-slanting processing) toward the axial direction which was not slanted toward the helical winding gap side, it was found that the resistance non-uniformity at the helical winding gap portion due to toner contamination was able to be reduced.

Embodiment 2

In this embodiment, the case where the wound brush subjected to the fiber-slanting processing is used as a primary charging brush will be described ((*a*) of FIG. 6). Incidentally, constituents identical to those in Embodiment 1 are represented by the same reference numerals or symbols and will be omitted from description.

In Embodiment 1, the cleaner-less constitution such that the electric charge of the untransferred toner which was not transferred onto the sheets was adjusted and collected by the developing device was employed. For that reason, the untransferred toner was directly supplied to the wound brush and therefore in the constitution, the resistance non-uniformity caused with respect to the brush roller longitudinal direction due to the toner contamination was liable to occur. In this embodiment, as the charging means for charging the photosensitive member, not only the wound brush was used but also the cleaning blade was provided upstream of the transfer portion and downstream of the charging means. Incidentally, in the case where the brush roller is used as the charging roller, there is no means for making uniform the potential of the photosensitive member at a downstream side of the wound brush roller to which the charging bias is applied. For that reason, the charging property of the wound brush roller is liable to be directly reflected on the image.

1. Schematic Structure of Image Forming Portion

Part (*a*) of FIG. 6 shows a schematic structure of the cartridge P as the image forming portion used in this embodiment. The photosensitive member 1 is charged by the charging brush 2 (wound brush roller) (by applying thereto the high voltage from the high voltage power source S1), and then the electrostatic image is formed on the photosensitive member 1 by the laser scanner 3 as the exposure means. The electrostatic image formed on the photosensitive member 1 is developed by the developing device 4 as the developing means, and then the formed toner image is transferred onto the recording material Pa and is fixed on the recording material Pa. Incidentally, the untransferred toner remaining on the photosensitive member 1 without being transferred onto the ITB 90 as the image bearing member is removed by the cleaning blade 8.

In this embodiment, the charging brush using the wound brush is rotated in a direction in which it is rotated by the rotation of the photosensitive member. Incidentally, in order to suppress charging non-uniformity of the photosensitive member, the charging brush is rotated at a peripheral speed two times higher than that of the photosensitive member. Here, the fiber material of the wound brush roller in this embodiment is nylon fibers, and a woven fabric brush, wound about the charging roller, having a fiber length of 3.0 mm, a fiber thickness of 3 denier and a density of 250 kF/inch$^2$ was used. Incidentally, the width of the base material was 10 mm.

2. Effect of Experiment

A result of the durability tests conducted in the same manner as in Embodiment 1 is shown in Table 2. The durability test was conducted by continuously outputting the image with image density (duty) of 20% (halftone image) on the whole surface of the A4-sized sheet and then the (non-uniformity of) output image was evaluated. At the same time, a potential difference ΔV was obtained by measuring an electric potential of two positions (areas) in which the potential difference contacts the fiber portion A2 and the helical winding gap portion A1. Incidentally, the image defect was evaluated by performing sensory evaluation by test subjects of 10 persons. Here, in the case where 10 persons judged the image defect as good, the evaluation result was "○". In the case where 7 persons or more judged the image defect as good, the evaluation result was "A". In the case where 6 persons or less judged the image defect as good, the evaluation result was "x".

TABLE 2

| | (sheets) | | |
|---|---|---|---|
| | 0 | 10,000 | 35,000 |
| Conv. | ○ (ΔV = 0 V) | x (ΔV = 20 V) | x (ΔV = 50 V) |
| EMB. 1 (−X) | ○ (ΔV = 0 V) | ○ (ΔV = 4 V) | Δ (ΔV = 20 V) |
| EMB. 1 (X) | ○ (ΔV = 0 V) | ○ (ΔV = 2 V) | ○ (ΔV = 15 V) |

In the conventional constitution, at the stage of the output of about 10,000 sheets, the density non-uniformity (white dropout in the pattern of the helical winding gap portion A1) was observed on the print and at that time, the potential difference ΔV was 20 V. This may be attributable to such a phenomenon that small toner and external additive which have passed through the cleaning blade stagnate in the helical winding gap of the brush and thus a resistance difference (resistance non-uniformity) is caused between the fiber portion A2 and the helical winding gap portion A2.

However, in the constitution in which the brush roller in this embodiment was employed, the image defect was not able to be observed at the time of the output of 10,000 sheets. Further, when the potential difference ΔV was checked, the potential difference ΔV was about 2 V. Further, also at the stage of the output of 35,000 sheets, the potential difference ΔV was 15 V and the occurrence of the image defect such that the white dropout of the halftone image was generated in the pattern of the helical winding gap portion A1 was not able to be observed. In other words, this may be because there is little difference in resistance difference between the helical winding gap portion A1 and fiber portion A2 of the charging brush and the charging brush is uniformly contaminated. Thus, the image defect due to a stripe-like contrast portion was not able to be observed until the potential difference of about 15 V occurred on the photosensitive member.

Thus, it was found that the constitution in this embodiment had a toner contamination-resistant property at the helical winding gap portion by tilting the fibers in the axial direction in which the fibers at the helical winding gap-downstream portion were not slanted toward the helical winding gap side.

Embodiment 3

In this embodiment, the case where the wound brush subjected to the fiber-slanting processing is used as a cleaning brush for cleaning the image bearing member such as the photosensitive member or the intermediary transfer member will be described ((*b*) of FIG. 6). Incidentally, constituents identical to those in Embodiment 1 are represented by the same reference numerals or symbols and will be omitted from description.

1. Schematic Structure of Image Forming Portion

Part (*b*) of FIG. 6 is a schematic view for illustrating a structure of a process cartridge in this embodiment. The photosensitive member 1 is charged by the charging roller 2 and the electrostatic image is formed by the laser scanner 3. The formed electrostatic image is developed into the toner image by the developing device 4. Thereafter, the toner image formed on the photosensitive member 1 is temporarily carried on the ITB 90 as the image bearing member and then is transferred onto the transfer material.

Here, the untransferred toner (+polarity), which is the toner which is not completely transferred onto the ITB 90, is collected into a collecting toner container (box) by a cleaning brush 15 (to which the DC voltage of −400 V is applied from the high-voltage power source S1) before being collected by a cleaning blade 8. The untransferred toner which is made uniform with respect to the longitudinal direction by the brush roller is supplied to the cleaning blade, so that it is possible to reduce toner slippage through the cleaning blade. When there is a difference in peripheral speed between the cleaning brush and the photosensitive member, there is a possibility of scattering or the like of the toner. For that reason, a constitution in which the cleaning brush 15 is rotated by the photosensitive member 1 is employed.

2. Effect of Experiment

A result of the durability tests conducted in the same manner as in Embodiment 1 is shown in Table 3. The durability test was conducted by continuously outputting the image with image density (duty) of 20% (halftone image) on the whole surface of the A4-sized sheet and then the (non-uniformity of) output image was evaluated. Incidentally, the image defect was evaluated by performing sensory evaluation by test subjects of 10 persons. Here, in the case where 10 persons judged the image defect as good, the evaluation result was "○". In the case where 7 persons or more judged the image defect as good, the evaluation result was "Δ". In the case where 6 persons or less judged the image defect as good, the evaluation result was "x". In addition, the (image) density was measured by using an optical reflection densitometer and it was found that in the case where a density difference (ΔD) exceeded 0.1, the density difference was recognized as the image defect.

TABLE 3

| | (sheets) | | |
|---|---|---|---|
| | 0 | 10,000 | 15,000 |
| Conv. | ○ (ΔD = 0.02) | x (ΔD = 0.10) | x (ΔD = 0.30) |
| EMB. 1 (−X) | ○ (ΔD = 0.02) | ○ (ΔD = 0.05) | Δ (ΔD = 0.07) |
| EMB. 1 (X) | ○ (ΔD = 0.02) | ○ (ΔD = 0.04) | ○ (ΔD = 0.05) |

In the case where the conventional brush roller which was not subjected to the fiber-slanting processing was used, at the stage of the output of 10,000 sheets, a vertical stripe-like image defect occurred. This is because the toner is accumulated in the helical winding gap of the brush to cause improper cleaning and thus causes slippage of the toner and the external additive through the charging roller. On the other hand, in the case where the brush roller subjected to the fiber-slanting processing, even at the stage of the output of 15,000 sheets, a problematic image defect did not occur. This may be because a lowering in performance of the cleaning brush 7 and the cleaning blade 8 was able to be suppressed by reducing the toner accumulation at the helical winding gap portion of the brush roller.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 145309/2010 filed Jun. 25, 2010 which is hereby incorporated by reference.

What is claimed is:

1. An image forming apparatus comprising:

an image bearing member;

a brush roller, rotatable in a predetermined rotational direction, contacted to said image bearing member; and applying means for applying a bias to said brush roller, wherein said brush roller includes a shaft and a woven fabric brush including fibers planted in a strip-like base material which is wound helically about the shaft with a helical winding gap, and wherein the woven fabric brush is subjected to fiber-slanting processing so that the fibers of the helically wound woven fabric brush are slanted, so as to cover the helical winding gap, from a downstream side toward an upstream side with respect to a longitudinal direction in which a helically extending widthwise edge of the base material is seen moving when said brush roller rotates in the predetermined rotational direction.

2. An image forming apparatus according to claim 1, wherein said brush roller is an auxiliary charging brush for adjusting an electric charge of untransferred toner.

3. An image forming apparatus according to claim 1, wherein said brush roller has been subjected to fiber-slanting processing by being heated.

4. An image forming apparatus comprising:

a photosensitive member;

a brush roller, rotatable in a predetermined rotational direction, contacted to said photosensitive member;

a power source configured to apply a bias to said brush roller; and a driving device configured to rotate said brush roller, wherein said brush roller includes a shaft and a woven fabric brush including fibers planted in a strip-like base material which is wound helically about the shaft with a helical winding gap, and wherein when a direction opposite to a direction in which the helical winding gap is seen moving in an axial direction of said brush roller when said brush roller rotates in the predetermined rotational direction is a direction X, 90% or more of the fibers of said brush roller are slanted in the direction X.

5. An image forming apparatus according to claim 4, further comprising:

a charging device configured to electrically charge said photosensitive member at a charging portion;

an exposure device configured to expose said photosensitive member, which is electrically charged, to form an electrostatic image;

a developing device configured to develop the electrostatic image, formed on said photosensitive member, with a toner to form a toner image;

a first transfer device configured to transfer the toner image, formed on said photosensitive member, onto an intermediary transfer member at a transfer portion; and a second transfer device configured to transfer the toner image from the intermediary transfer member onto a recording material, wherein said brush roller is provided downstream of the transfer portion and upstream of the charging portion with respect to a rotational direction of said photosensitive member, and wherein said power source applies to said brush roller a bias of a polarity identical to that of a normal charge polarity of the toner.

6. An image forming apparatus according to claim 4, further comprising:

a charging device configured to electrically charge said photosensitive member at a charging portion;

an exposure device configured to expose said photosensitive member, which is electrically charged, to form an electrostatic image;

a developing device configured to develop the electrostatic image, formed on said photosensitive member, with a toner to form a toner image; and a transfer device configured to transfer the toner image, formed on said photosensitive member, onto a recording material at a transfer portion, wherein said brush roller is provided downstream of the transfer portion and upstream of the charging portion with respect to a rotational direction of said photosensitive member, and wherein said power source applies to said brush roller a bias of a polarity identical to that of a normal charge polarity of the toner.

7. An image forming apparatus according to claim 4, wherein said brush roller is a charging device for electrically charging said photosensitive member, wherein said image forming apparatus further comprises:

an exposure device configured to expose said photosensitive member, which is electrically charged by said brush roller, to form an electrostatic image; and a developing device configured to develop the electrostatic image, formed on said photosensitive member, with a toner to form a toner image, and wherein said power source applies to said brush roller a bias of a polarity identical to that of a normal charge polarity of the toner.

8. An image forming apparatus according to claim 4, wherein said driving device rotates said brush roller, at a contact portion with said photosensitive member, in a direction along the rotational direction of said photosensitive member, and wherein a peripheral speed of said brush roller is faster than a peripheral speed of said photosensitive member.

* * * * *